US008662788B2

(12) United States Patent
Sippola

(10) Patent No.: US 8,662,788 B2
(45) Date of Patent: Mar. 4, 2014

(54) TACTILE EMBEDMENT PLATE ASSEMBLY WITH AN ALIGNMENT BRACKET

(75) Inventor: Duane F. Sippola, Madison, WI (US)

(73) Assignee: MetaDome, LLC, Madison, WI (US)

( * ) Notice: Subject to any disclaimer, the term of this patent is extended or adjusted under 35 U.S.C. 154(b) by 3 days.

(21) Appl. No.: 13/453,085

(22) Filed: Apr. 23, 2012

(65) Prior Publication Data

US 2013/0279978 A1 Oct. 24, 2013

(51) Int. Cl.
*E01C 9/08* (2006.01)

(52) U.S. Cl.
USPC ..... 404/36; 404/9; 404/34; 404/35; 404/37; 404/40; 404/41; 404/42; 404/43; 404/45; 404/47; 404/134; 404/135

(58) Field of Classification Search
USPC ..... 404/29, 34–41
See application file for complete search history.

(56) References Cited

U.S. PATENT DOCUMENTS

| | | | | |
|---|---|---|---|---|
| 22,035 | A * | 11/1858 | Savage | 34/237 |
| 731,158 | A | 6/1903 | Blackmore | |
| 1,412,504 | A | 4/1922 | Byrne | |
| 1,429,400 | A | 9/1922 | Bloedow et al. | |
| 2,478,993 | A | 7/1946 | Wing | |
| 2,485,165 | A | 10/1949 | Pollman | |
| 3,196,763 | A | 7/1965 | Rushton | |
| 3,222,040 | A | 12/1965 | Eckert | |
| 3,311,939 | A | 4/1967 | Yamamoto et al. | |
| 3,447,731 | A | 6/1969 | Lehmann | |
| 3,620,027 | A | 11/1971 | Nordell | |
| 3,802,790 | A | 4/1974 | Blackburn | |
| 3,841,776 | A | 10/1974 | Klaus | |
| 3,902,255 | A | 9/1975 | Harte | |
| 4,331,218 | A | 5/1982 | Layher | |
| 4,377,016 | A | 3/1983 | Niermeijer | |
| 4,706,424 | A | 11/1987 | Garapick et al. | |
| 4,715,743 | A | 12/1987 | Schmanski | |
| 4,883,394 | A | 11/1989 | Van der Woude et al. | |
| 5,009,045 | A | 4/1991 | Yoder | |
| 5,052,161 | A | 10/1991 | Whitacre | |
| 5,217,319 | A | 6/1993 | Klohn | |
| 5,303,669 | A | 4/1994 | Szekely | |
| 5,385,770 | A | 1/1995 | Julnes | |
| 5,399,406 | A | 3/1995 | Matsuo et al. | |
| 5,403,637 | A | 4/1995 | Pickard et al. | |
| 5,616,389 | A * | 4/1997 | Blatz | 428/45 |
| 5,619,832 | A | 4/1997 | Myrvold | |
| 5,775,835 | A | 7/1998 | Szekely | |
| 6,199,340 | B1 | 3/2001 | Davis | |

(Continued)

FOREIGN PATENT DOCUMENTS

WO WO02/086247 10/2002

OTHER PUBLICATIONS

Drawing of Prior Art Advantage Tactile Systems Embedment Tile, 1p., Feb. 2006.
Drawing of Prior Art Armor—Tile Embedment Tile, 1p., Jan. 2007.

(Continued)

*Primary Examiner* — Raymond W Addie
(74) *Attorney, Agent, or Firm* — Smith Law Office

(57) ABSTRACT

Tactile detection embedment plates used in pedestrian walkways releasably aligned by a bracket on at least one of the embedment plates. The bracket can be mated with a bracket on another plate to define a receiver yoke in which a wedge is disposed for a releasable plate assembly connection.

28 Claims, 10 Drawing Sheets

(56) References Cited

U.S. PATENT DOCUMENTS

| | | | |
|---|---|---|---|
| 6,449,790 | B1 | 9/2002 | Szekely |
| 6,450,728 | B1 | 9/2002 | Grahmbeek et al. |
| 6,588,975 | B2 | 7/2003 | Ross |
| 6,594,961 | B2 | 7/2003 | Leines |
| 6,607,329 | B2 | 8/2003 | Smith |
| 6,663,315 | B2 | 12/2003 | Smith |
| 6,688,805 | B1 | 2/2004 | Kochling |
| 6,715,956 | B1 | 4/2004 | Weber et al. |
| 6,718,714 | B1 | 4/2004 | Montgomery, Sr. |
| 6,895,622 | B2 | 5/2005 | Szekely |
| 7,007,437 | B2 | 3/2006 | Thomas |
| 7,080,954 | B2 | 7/2006 | Monneret et al. |
| 7,771,814 | B2 | 8/2010 | Grimble et al. |
| 7,779,581 | B2 | 8/2010 | Flaherty et al. |
| 7,845,122 | B2 | 12/2010 | Sippola |
| 8,146,302 | B2 | 4/2012 | Sippola |
| 2004/0042850 | A1 | 3/2004 | Provenzano, III |
| 2005/0066623 | A1 | 3/2005 | Sippola |
| 2010/0129150 | A1 | 5/2010 | Sippola |
| 2012/0076579 | A1* | 3/2012 | Flaherty et al. ..... 404/35 |

OTHER PUBLICATIONS

Photographs of Prior Art Advantage Tactile Embedment Tile dated Jan. 12, 2009, 5pp.

U.S. Appl. No. 60/505,794, filed Sep. 25, 2003 (Our .503).

U.S. Appl. No. 60/660,529, filed Mar. 10, 2005 (Our .504).

* cited by examiner 20
34

214
212
26

34
26

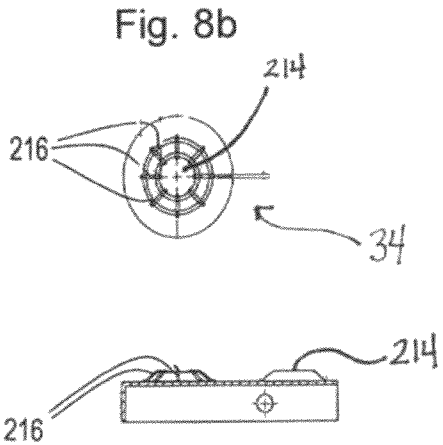
Fig. 8b
Fig. 8c
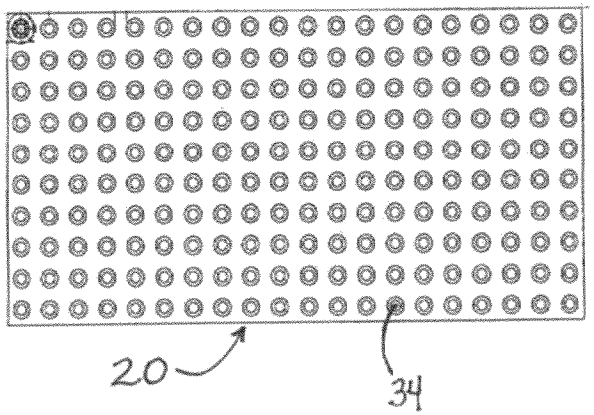
Fig. 8a

TACTILE EMBEDMENT PLATE ASSEMBLY WITH AN ALIGNMENT BRACKET

FIELD AND BACKGROUND OF THE INVENTION

This invention relates generally to tactile detection embedment plates used in pedestrian walkways, and more particularly to tactile detection plates aligned with a bracket and/or releasably joined together with a bracket connector.

The Department of Justice (DOJ) oversees implementation and enforcement of the Americans with Disabilities Act (ADA), and has mandated that many walkway surfaces include some form of tactile detection for visually impaired persons. One of the primary ways to provide tactile detectors near hazardous locations (e.g., roadways, railroad crossings, etc.) is with embedment plates having distinctive surface patterns of domes detectable by cane or underfoot to alert the visually impaired that they are approaching potential hazards.

Municipalities, non-governmental entities, such as land developers, railroad companies and others who likewise need to provide tactile-detectable surfaces in pedestrian walkways obviously seek low-cost solutions to implement and maintain tactile surfaces. Various embedment plates, plate materials, and methods for installing plates are known. For example, known plates are made of plastic, steel, and cast iron having tactile surfaces with truncated domes extending upward from the plates. The plates are typically rectangular, triangular wedge square or radial in shape and are installed in concrete or asphalt during construction of the walkway.

Some of these devices are made out of flimsy plastic and are subject to ultraviolet light damage, deterioration and cracking in short periods of time. Also, inherent in the truncated dome design is the exposure of domes to severe impacts by snowplow equipment, particularly snowplow blades and end-loader buckets. Domes made of plastic tend to be sheared off, nicked or cracked when snowplows hit them. Once damaged, the entire plastic embedment plate must be removed and replaced. Attempts to address these problems can be found in U.S. Pat. Nos. 5,775,835 to Szekely; 6,449,790 to Szekely; 6,715,956 to Weber et al.; and, U.S. Patent Application Publication US 2004/00428 to Provenzano, III. However, each one of these disclosures suffers from one or more disadvantages.

Steel and cast iron embedment plates are also used. Cast iron plates in particular can be extremely heavy. The size of typical cast iron detectable warning plates are two feet by two feet (2'×2') and weigh approximately 70 lbs. (+/−) each. Typical curb opening ramp widths are a minimum of four feet (4') wide so it normally requires two plates for typical curb ramps. Since the current plates are heavy, it normally takes two people to safely lift and place one plate at a time into a concrete ramp. Smaller and lighter weight cast iron plates that are less labor intensive, easier to handle, and install into concrete or asphalt are desirable for general safety reasons. When multiple embedment plates are used, they must be installed edge-to-edge and co-planar with one another. Even skilled and patient installers can find it difficult to properly install large heavy embedment plates in concrete and asphalt. It is particularly difficult when two (2) or more 70 lb. cast iron plates have to be set side by side in fresh concrete or asphalt. Steel and cast iron plates are desirable for durability and strength, so precise installation remains a challenge with heavy two foot (2'×2') square cast iron plates.

Thus, there is a need for a lighter and durable embedment plate that can be easily aligned with and/or joined to the sides of adjoining plates.

SUMMARY OF THE INVENTION

The present invention is directed to an embedment plate with an alignment bracket that aligns and/or joins two embedment plates in a secure, close-fitting, and co-planar relationship. In addition, the embedment plates can be constructed with the features disclosed in U.S. patent application Ser. No. 12/077,739, which is incorporated herein by reference.

With the present invention, releasably joined plates can be quickly aligned with and/or connected to adjoining plates by one person as necessary to comply with ADA requirements. Also, several connected plates can be installed at one time to make larger and more complex plate assemblies quicker to install. Releasably joined plates can be assembled off-site or can be assembled on site just prior to installation. Several releasably joined plates in a plate assembly can be used to speed up the installation process of long plate assemblies, especially at railroad passenger loading and unloading platform areas where there may be continuous detectable warning surfaces of one hundred feet (100') or more. When longer assemblies of releasably joined plates are connected, it may require an additional person to assist with installation or it may require a piece of equipment that can lift a number of assembled plates at once and place them into the concrete or asphalt. In some embodiments, the use of smaller sized plates in releasably joined assemblies are safer to handle and easier for one person to manipulate as the plate assembly is placed into a concrete ramp.

Various layouts or applications for releasably joined plates can be used with the present invention to accommodate the size and shape of the area, the number of people available to install plate assemblies, and the type of lifting equipment available. Thus, the present invention is adaptable to all types of installations. Lighter weight releasably joined plates are easily loaded and unloaded from truck beds and can be hand carried to a job site where they can be assembled (joined) to create any desired ramp size or shape. The relatively light weight of releasably joined cast iron plates provides safe, fast and efficient detectable warning installations.

One embodiment of the present invention includes a plate with a tactile detection surface for embedment in a moldable material. The plate has at least one edge for alignment with an edge of an adjacent plate. At least one plate includes a bracket for supporting and aligning an adjacent plate in an embedment plate assembly. The bracket can have a shoulder that enables quick and accurate alignment and installation of heavy embedment plates simply by inserting the bracket under an adjacent embedment plate.

Further, the bracket can be aligned with a bracket on an adjacent embedment plate to define a receiver yoke into which a wedge can be placed to releasably connect the plates together into a plate assembly for ease of placement into a moldable material.

The bracket need not include a shoulder and might only be used to align with a bracket on an adjacent plate to define a receiver yoke into which a wedge is placed to releasably join the plates together.

The bracket can further include a lip that engages a recess or other mating surface in the bottom side of an adjacent plate. Once in the recess, the lip can resist lateral movement of adjacent plates away from each other, as well as provide quick alignment of the plates during installation because no further connectors are necessary. Proper plate alignment can be noticeable by the installer when the lip and recess engagement is felt during placement of an adjacent plate.

Another embodiment of the present invention is directed to a plate assembly having: a first plate; a first bracket joined to the first plate; a second plate arranged co-planar and adjacent to the first plate; a second bracket joined to the second plate and aligned with the first bracket to define a receiver yoke between the brackets; and a wedge disposed in the receiver yoke to thereby connect the two embedment plates. The plate assembly first bracket can be disposed adjacent to the second bracket or they can be spaced apart.

The plate assembly first bracket can include a first wedge surface spaced outwardly from the first plate; and the second bracket can include a second wedge surface spaced outwardly from the second plate and spaced apart from the first wedge surface to define the receiver yoke into which the wedge is disposed. More than one wedge can be used in a single receiver yoke.

The plate assembly can further include: a second pair of alignment connector brackets having a first bracket joined to the first plate; and a second bracket joined to the second plate, and the first bracket and the second bracket have portions spaced apart from one another to define a receiver yoke therebetween. A second wedge can be placed into this receiver yoke or an elongate wedge from an adjacent receiver yoke can be used in both.

The plate assembly wedge member can be a rod or a rod with a substantially round cross-sectional shape, such as a concrete reinforcing bar commonly used on construction sites where embedment plates are being installed. Other cross-sectional shapes such as threaded wedge members square channel, angle iron and etc. can be used.

Another plate assembly in accordance with the present invention includes: a first plate; a second plate adjacent to and co-planar with the first plate; a first bracket joined to the first plate and positioned at least partially under the second plate; a second bracket joined to the second plate and positioned at least partially under the first plate, and positioned relative to the first bracket to define a receiver yoke; and a wedge member removably disposed in the receiver yoke. The plate assembly receiver yoke can be elongated and substantially parallel to an edge of the first plate, and substantially parallel to an edge of the second plate. The plate assembly receiver yoke can be wedge-shaped with a wide portion of the wedge near the distal ends of the brackets and the narrow portions of the wedge near the proximal ends of the brackets. And the wedge can be sized to be wedged in the receiver yoke to push the brackets apart and thereby draw the first plate and the second plate together.

The plate assembly receiver yoke can be defined by a first surface on the first bracket, and the first surface faces toward the first plate, and a second surface on the second bracket, and the second surface faces toward the second plate; and the wedge member is wedged between the first surface and the second surface. The plate assembly first surface and the second surface can define a wedge-shaped receiver yoke, and the wedge member can be a rod with a substantially round cross-sectional shape, any other shape and/or can be threaded.

The plate assembly first bracket can have a shoulder on which a lower surface of the second plate bears; and the second bracket can have a shoulder on which a lower surface of the first plate bears. The shoulders thereby aid in the co-planar alignment of the two connected plates. The shoulders can be provided with a lip that mates with a notch, recess or other surface in the underside of a mating plate to further secure and align the plates, as well as aid in installing the plates in moldable material.

The plate assembly first bracket can include a first foot; and the second bracket can include a second foot to help stabilize and support the plate assemblies prior to or during installation. The plate assembly bracket can be joined to the plate or molded integrally therewith.

The invention is also directed to an alignment connector for joining a first plate to a second plate so that the first plate and second plate are substantially co-planar, the alignment connector includes a first bracket joined to the first plate and a second bracket joined to the second plate. The two brackets can be aligned to define a receiver yoke into which a wedge is releasably disposed. The alignment connector first bracket can have a shoulder on which the second plate bears; and/or the first bracket can have a shoulder on which the second plate bears. The alignment connector first bracket can also have a wedge surface that at least partially defines the receiver yoke. The shoulders can be provided with a lip that mates with a notch in the underside of a mating plate to further secure and align the plates.

When the bracket includes a foot, the plates can be dry set (probably on brick pavers or similar to bring them to finish grade) into a formed area and then concrete can be placed into the frame, around the plates, and shoved or vibrated underneath the plates. This may be desirable for large assemblies and particularly beneficial for long assemblies, particularly at railroad passenger loading and loading areas.

The present invention is also directed to a method for installing plate assemblies for being cast in concrete or asphalt pavement. The method includes the steps of: setting a first plate in a desired position for a detectable warning surface; bringing a second plate substantially edge-to-edge and in a non-coplanar relationship with the first plate; and pivoting the second plate toward a co-planar position with the first plate to insert a bracket extending from the second plate under the first plate and into a co-planar position with the first plate to bring the bracket into bearing support of the first plate. The step of pivoting the second plate toward a co-planar position with the first plate can comprise the step of: engaging a lip on the bracket of the second plate with a notch on the first plate to releasably join the second plate and the first plate in an edge-to-edge relationship.

The step of pivoting the second plate more toward a co-planar position with the first plate can comprise the step of: aligning the bracket on the second plate with a bracket on the first plate to define a receiving yoke. This step can be followed by the step of: inserting a wedge into the receiving yoke. The step of pivoting the second plate toward a co-planar relationship with the first plate can also comprise the step of: bringing a bracket on the first plate into bearing support of the second plate.

The method can further include the step of placing a moldable material around and under the first plate and the second plate to form pavement having a detectable warning surface. Alternately, or in addition, the method can be performed by placing the first plate and the second plate into uncured moldable material.

The method can further comprise the steps of: engaging a lip on the bracket with a notch in the first plate to create a plate assembly of the second plate and the first plate; and installing the plate assembly into a pavement location to at least partially define a detectable warning surface. The pavement location can have the moldable pavement material already in place or it can be added after the plate assembly is installed into the pavement location.

These and other embodiments, features and benefits are provided by the present invention.

BRIEF DESCRIPTION OF THE DRAWINGS

FIG. 8*a*, shows a top view of a embedment plate 20 similar to that of FIG. 7*a*, but showing a version of a projection 34 having reinforcement ridges 216 thereon in the upper left corner;

FIG. 8*b*, shows a detailed top view of the ridged projection of FIG. 8*a;*

FIG. 8*c*, shows a side view of two projections 34, on the left a projection with reinforcement ridges 216 and on the right a projection without reinforcement ridges.

DETAILED DESCRIPTION OF THE INVENTION

Figure 1:
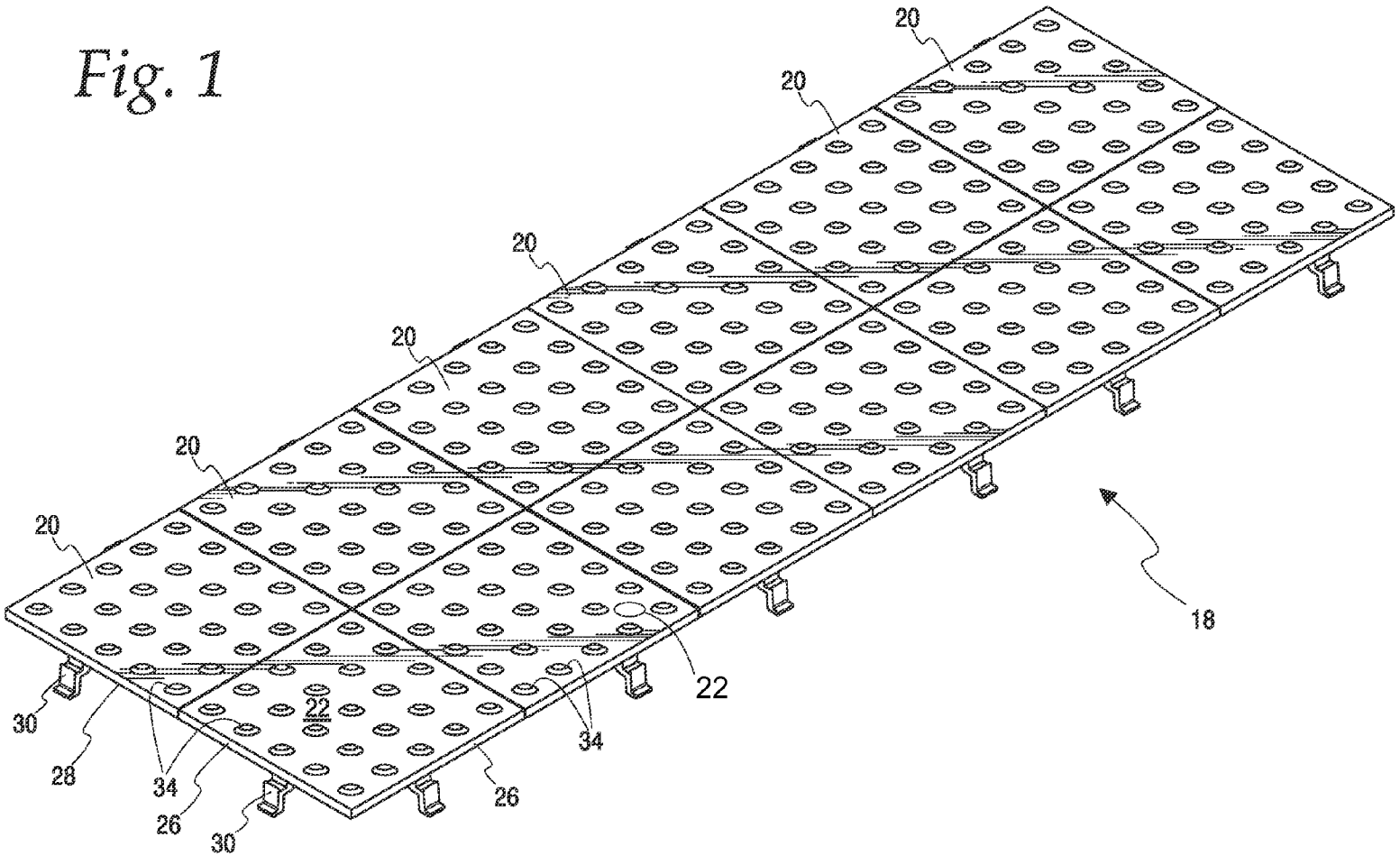
FIG. 1 is a perspective view of a tactile embedment plate assembly with alignment connector portions in accordance with the present invention.
Figure 2:
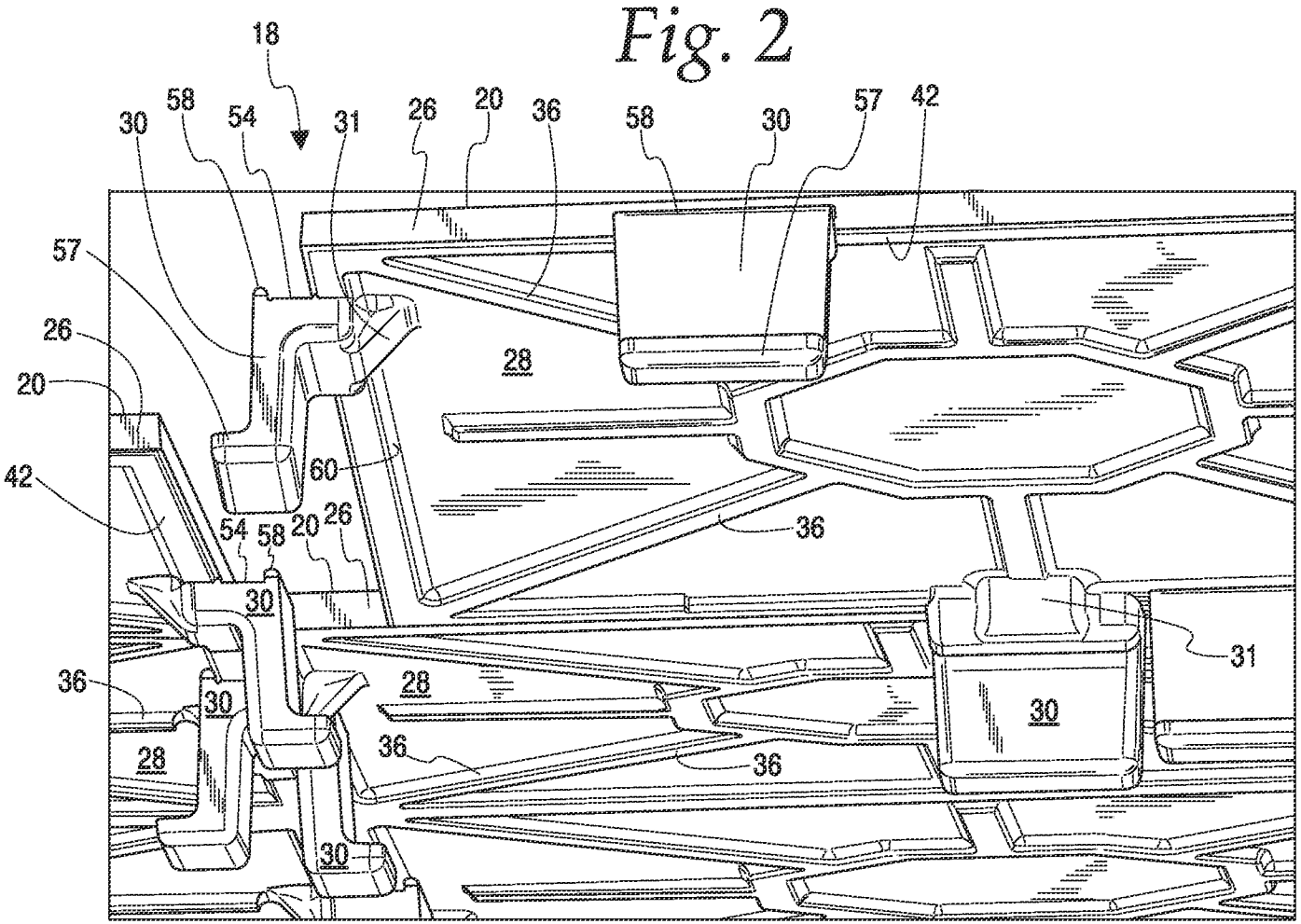
FIG. 2 is a partial perspective view of an underside of a partially assembled tactile embedment plate assembly.

In the following detailed description, the same reference numerals will be used for the same or similar elements illustrated in each of the figures.

Illustrated in FIGS. 1 through 6 is an embedment plate assembly 18 in accordance with the present invention. Each embedment plate assembly 18 includes: embedment plates 20 (sometimes referenced herein as 20A or 20B for clarity), an upper surface 22, four edges 26, a bottom surface 28, and a number of alignment brackets 30 joined to the bottom surface 28. The embedment plates 20 can be square, rectangular, or any desired shape. Also, the embedment plate 20 is depicted as substantially flat, but it can have surface contours that conform to and/or define the final shape of a pedestrian walkway. For example, the same design can be constructed to meet the needs of a user for different shapes, including, for example, skewed curb ramp approaches, blended sidewalk approaches, sides of curb ramp approaches and the like where the number of side edges may vary. The embedment plate 20 may further be cut and trimmed for customized fitting to certain areas.

Manufacturing tolerances and possibly even desired surface shapes can result in the upper surface 22 not being perfectly flat. Thus, the upper surface 22 and even the embedment tile 20 are described for simplicity herein as "substantially flat" to accommodate desired and undesired shapes and contours. The embedment plate 20 is preferably made of cast iron (illustrated) or steel, but other materials and combinations of materials can also be used.

The upper surface 22 includes projections 34 and embossments 38. The projections 34 and embossments 38 are preferably formed integrally with the upper surface of the embedment plate 20, but they may be joined by other means, as well. The projections 34 and embossments 38 are preferably arranged as illustrated in FIG. 1, but other arrangements, spacings, and designs can be used. Indeed, the tactile embossments 38 are preferred, but not necessary. Other textures can be used between the projections, including textured paint, coating, ridges, grooves, or any other desired texture or treatment. Other features of the projections are described in detail below.

In an alternate embodiment, the embedment plate 20 is capped with and joined to a cover plate with suitable connectors (not illustrated). In this manner, the embedment plate 20 can have a reduced thickness, be made of lighter material, and/or be smooth so that the cover plate can be made of more durable material and include tactile domes, other features, or designs, including advertising. Therefore, as used herein, the term "embedment plate" can be a single plate, double plate, or any combination of plates or frames that are joined with an alignment connector or bracket in accordance with the present invention.

As depicted in FIGS. 2 through 6, the bottom surface 28 is substantially flat and preferably includes reinforcing ribs 36. The reinforcing ribs 36 are illustrated as areas of increased thickness. The reinforcing ribs 36 are preferably formed integrally with the embedment plate 20, but they can be joined by any other means. Also, the reinforcing ribs 36 can be any desired size and spacing. In some embodiments, the reinforcing ribs 36 can also aid installation and embedment, such as those described and depicted in U.S. Ser. No. 12/077,739, the entire disclosure of which is incorporated herein by reference.

The edges 26 are preferably straight, smooth, and free of sharp edges for ease and safety of handling. Nonetheless, the edges 26 can be curved or define projections and recesses (not illustrated) for mating with adjoining embedment plates. The thickness of the edge 26 can be any preferred dimension and will generally depend on the weight and strength of material used to make the embedment plate 20. Further, the edges 26 are preferably thicker than the rest of the embedment plate 20 to provide increased rigidity for a given plate thickness.

The bottom surface 28 includes a bearing surface 42 that is preferably defined by an area of increased thickness around the periphery of the plate 20. The bearing surface 42 does not need to extend completely around the embedment plate 20, but it should be located to mate with the alignment connector brackets 30, as described below. Even when there is no increased thickness around the edges 26, a bearing surface 42 is defined and will bear on an alignment bracket, as described below.

When one embedment plate 20 is to be installed adjacent to another, it is desirable to align them by mating their respective edges closely together and arranging them so their upper surfaces are co-planar. As used herein, "co-planar" describes any relationship between adjacent embedment plates 20 that results in their being compatible, including in the same flat plane, or of the same or complimentary shape. Installing embedment plates 20 in uncured concrete or asphalt therefore requires upper surface alignment with adjacent walkway surfaces and embedment plates 20. Moving, placing, and adjusting embedment plates 20 in uncured concrete or asphalt is difficult even for skilled workers, but accurate alignment is required for safety and aesthetic reasons.

The brackets 30 of adjacent plates 20 can be used to form an alignment connector that aligns adjacent embedment plates 20 edge-to-edge and in a co-planar relationship. The alignment connector is preferably incorporated into at least one bracket 30 on each adjacent embedment plate 20. Each bracket 30 is joined to its respective embedment plate 20 by molding, welding, integral forming, bolting or other suitable manner. As illustrated, the bracket 30 is joined to the bottom surface 28 of the embedment plate 20 with a reinforcing gusset 31 to improve connection strength. The bracket 30 in the preferred embodiment is made of the same material as the embedment plate 20, in the preferred, cast iron. Other embodiments are possible that have brackets 30 and embedment plates 20 made of different materials, including composites of materials.

As illustrated in FIGS. 1 to 4, and 6, there can be a number of brackets 30 joined to each embedment plate 20 with at least one bracket 30 on each edge 26, but two or more brackets 30 can be used on each edge 26 of longer or larger embedment plates 20. Placing a bracket 30 on each edge 26 of an embedment plate 20 enables all edges 26 to be aligned with another embedment plate 20. If an edge 26 is not aligned with another embedment plate 20, the bracket 30 will be buried in concrete or asphalt and serve as an anchor when the concrete or asphalt cures without being an obstruction. (See FIG. 10, for example.)

Figure 4:
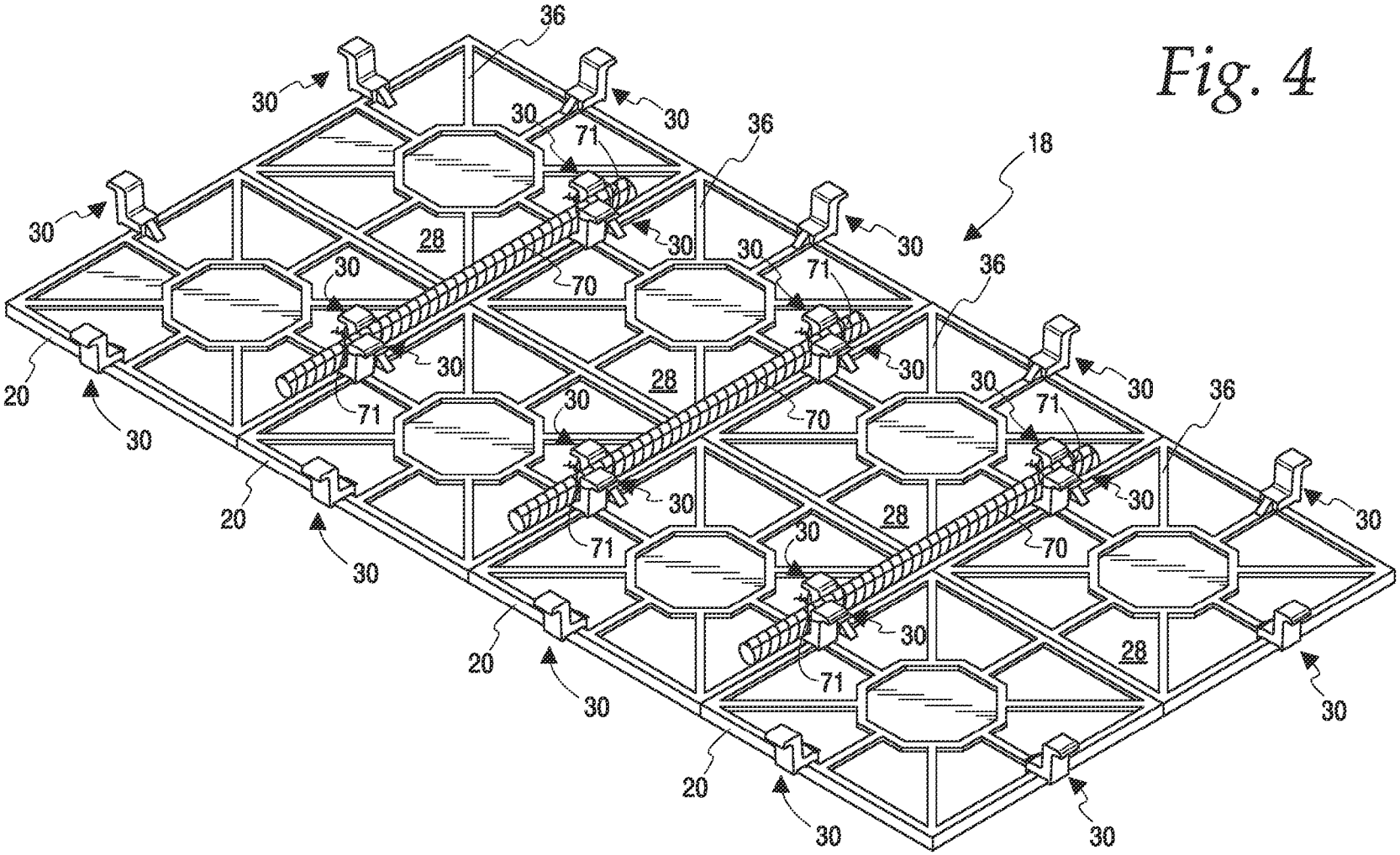
FIG. 4 is a bottom view of the tactile embedment plate assembly showing wedges secured to brackets with wire ties, in accordance with the present invention.
Figure 6:
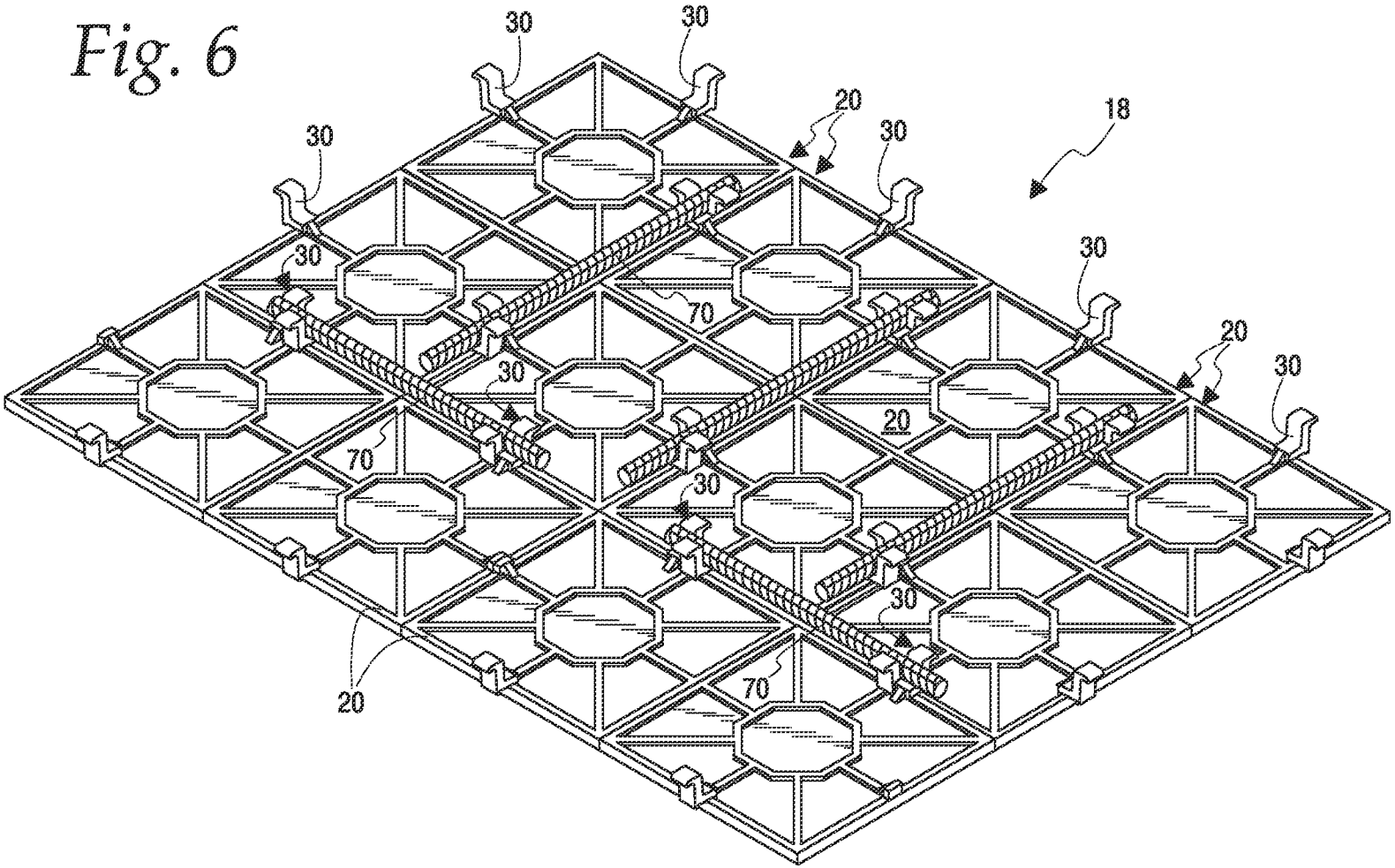
FIG. 6 is a perspective view of the underside of a plate assembly having two connectors and a single wedge disposed in both connectors, in accordance with the present invention.

As best illustrated in FIGS. 4 and 6, the brackets 30 are preferably arranged so that when two embedment plates 20 are positioned edge-to-edge, the brackets 30 on each will be adjacent to one another, but this arrangement is not necessary because the brackets 30 can be spaced apart or be any length relative to the edge 26 of an embedment plate 20, and still align the embedment plates 20.

As seen in FIGS. 2 through 5B, each bracket 30 includes a shoulder 54, a leg 56, and a foot 57. The shoulder 54 extends outwardly from the embedment plate 20 bottom surface 28. A portion of the shoulder 54 is preferably formed integrally with or welded to the bottom surface 28 of the embedment plate 20 to aid in aligning plates 20, as described below. The shoulder 54 of this embodiment provides support for an adjacent embedment plate 20. In this manner, the upper surface 22 of adjacent embedment plates 20 will be co-planar. The shoulder 54 also preferably includes a lip 58 that mates with a corresponding notch 60 on an adjacent embedment plate 20. "Notch" as used herein, includes any surface on an embedment plate that mates with the lip 58. The shapes and sizes of the lip 58 and the notch 60 are illustrated as preferred, but other shapes and sizes are possible within the scope of the present invention.

Figure 5A:
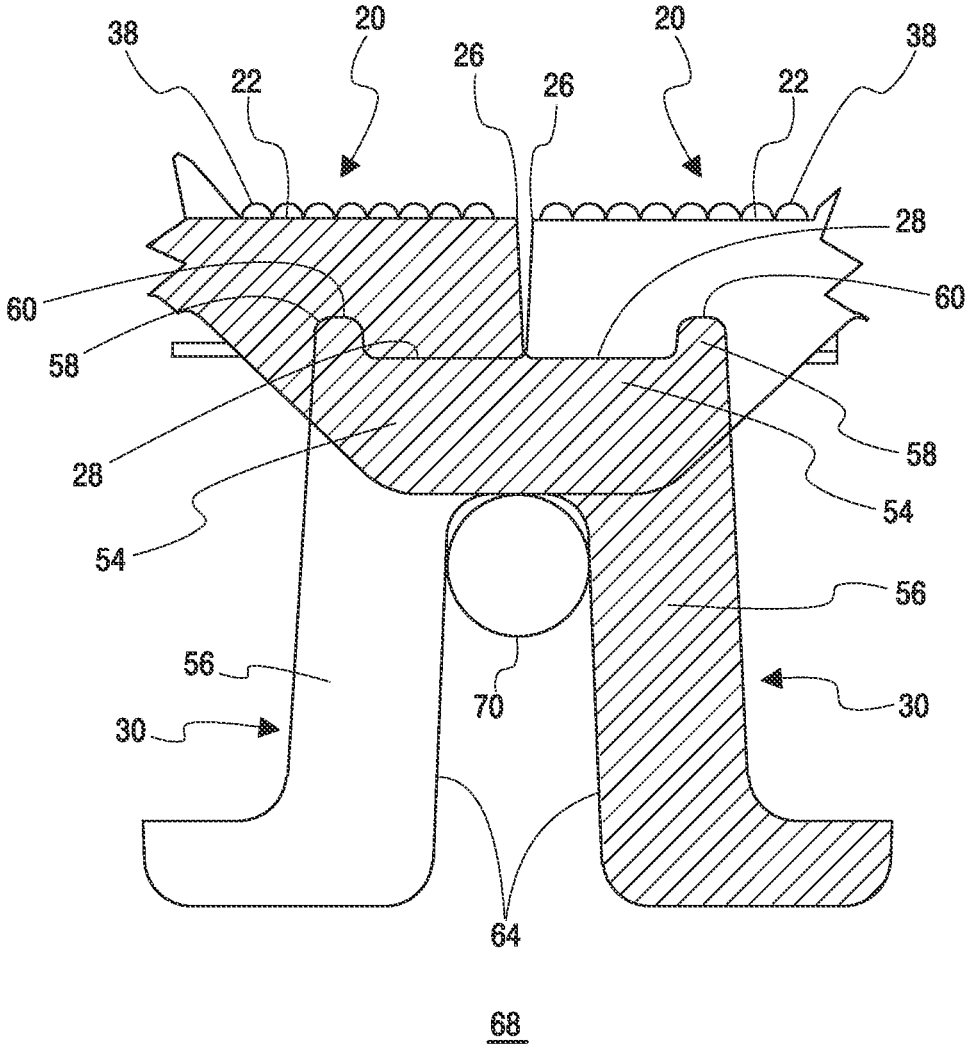
FIG. 5A is a side view of an alignment connector bracket, in accordance with the present invention.
Figure 5B:
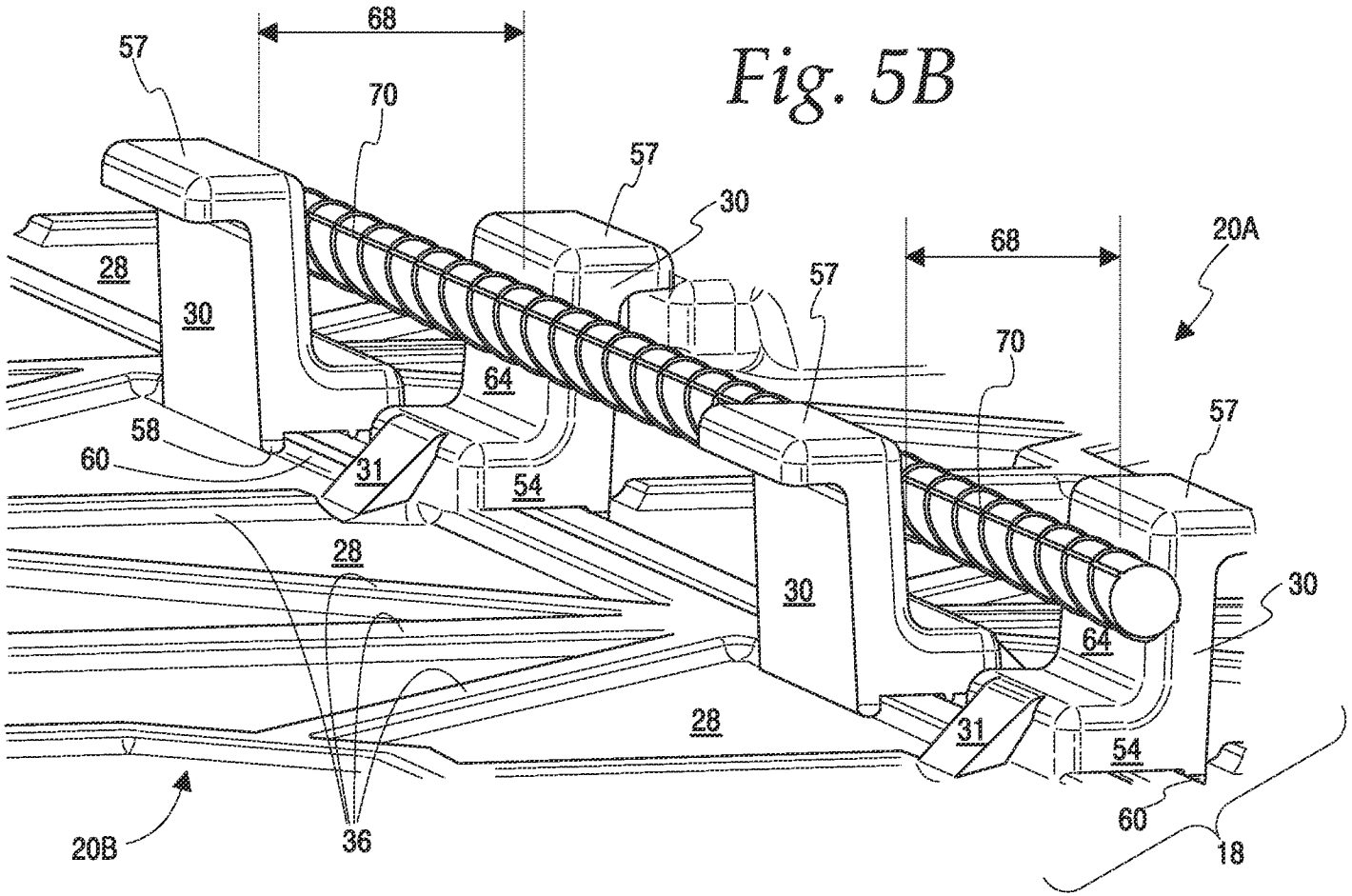
FIG. 5B is a partial perspective view of two embedment plates joined by an alignment connector, in accordance with the present invention.

As illustrated in FIGS. 5A and 5B, the downwardly extending leg 56 of the bracket 26 preferably includes a wedge surface 64 that cooperates with a wedge surface 64 on an adjacent plate's brackets 30 to define a receiver yoke 68 into which a wedge 70 can be positioned to engage the two brackets 30, and the two adjacent embedment plates 20. Preferably, the wedge surface 64 of each bracket 30 is angled away from its respective embedment plate 20, so that the receiver yoke 68 is relatively wide at the bottom, but tapers inward toward the top to a relatively narrow space into which the wedge 70 can be jammed. The wedge surface 64 is preferably straight and angled away from the embedment plate 20, but the wedge surface 64 can be curved or include embossments or other treatments to enhance its connection to the wedge 70. The wedge 70 can be effective in any position in the receiver yoke 68, and it does not need to be inserted into the narrowest portion of the receiver yoke 68. In this matter, wedges of various sizes, shapes, and diameters can be used without requiring a change in bracket size or shape.

The wedge 70 in a preferred embodiment will remain in the wedge-shaped receiver yoke 68 due to friction, but it can also be secured in other ways such as a snap fit or with embossments, for example. The receiver yoke 68 can be any shape, but using a wedge-shaped receiver yoke results in the wedge 70 pressing into the receiver yoke 68 to draw the adjacent embedment plates 20 together for a relatively tight fit along their respective edges 26. Other shapes can be used to correspond to the wedge surface 64 shapes described above.

FIG. 3 illustrates one example for assembling two plates 20 edge-to-edge. One plate 20A is set in a desired location and another plate 20B is positioned next to it at an angle. The bracket 30 of the second plate 20B, is positioned under the first plate 20A until the lip 58 is inserted into the notch 60 and the second plate 20B then lowered into position.

The second plate 20B can slide parallel and along the edge of the first plate 20A after the lip 58 is engaged with the notch 60. Indeed, in some installations, it might be easier to align the plates 20A and 20B by sliding the second plate 20B along the edge of the first plate 20A, in this manner, so that the plates 20A and 20B are engaged and then plate 20B is moved into a desired position.

The plates 20A and 20B can be assembled this way directly in uncured moldable material or before being placed in moldable material. If assembled before placing in moldable material, a wedge 70 can be used to join the two plates together so they can be placed, as an assembly, into moldable material.

The bracket foot 57 provides an anchor when concrete or asphalt cures around it. The foot 57 is desirable, but not necessary, and can be used to prevent the bracket 30 from penetrating the moldable material too deeply or too quickly during installation. Further, the foot 57 can be any desired shape, and it can be solid or define a cavity into which moldable material can flow and cure for improved anchoring.

The wedge 70 can be any desired shape so long as it mates with the receiver yoke 68. The wedge is preferably a rod, such as a concrete reinforcing bar, which is a common item around building sites where embedment plates are installed. Reinforcing bars are typically made of steel, but other materials that are rigid or flexible, can be used. Preferably, the reinforcing bar wedge 70 used in the invention is about one-half inch in diameter ("a No. 4 bar"), but other diameters can be used, particularly if the receiver yoke 68 is wedge-shaped and sized to accommodate different diameter reinforcing bars. Other wedge 70 shapes and constructions are possible, including square, wedge-shape, and triangular cross-sections. Also, the wedge 70 can have threaded ends for connecting to other wedges 70, or to one or more brackets 30, or both.

The wedge 70 can also be used in more than one connector receiver yoke 68. For example, a long bar can be secured in more than one receiver yoke 68. (FIGS. 4 and 6) This type of wedge 70 can also provide added stability to the plate assembly.

To join two embedment plates 20, the embedment plate 20 edges are brought together in a desired arrangement with the brackets 30 from one embedment plate 20 extending beneath the adjacent embedment plate 20. Each embedment plate 20 rests on the shoulder 54 of the mating embedment plate's 20 bracket 30, and preferably the lip 58 of one bracket 30 mates with the notch 60 on the adjacent embedment plate 20.

The wedge 70 typically remains in place due to friction and a compressive force from the brackets 30 because they are flexed somewhat when the wedge 70 is set in place. In addition, as seen in FIG. 4, wire ties 71 can be used to secure the wedge 70 in place for transport or placement into uncured moldable material. Other methods and devices can be used to secure the wedge 70 in place, if desired.

This arrangement further results in the brackets 30 defining a receiver yoke 68 into which a wedge 70 (such as a concrete reinforcing bar) is inserted and wedged or jammed into place using any suitable means. Typically, no tools are needed and the wedge 70 can be inserted and wedged into place by hand, but hammers and other tools can be used. Preferably, with little effort, the wedge 70 can be jammed into the receiver yoke 68, but the fit permits the wedge to be removed. The wedge 70 can be threaded or at least have thread ends to be secured in place or to another wedge 70 with a nut, for example (not illustrated).

With the wedge 70 in place, the two embedment plates 20 are releasably joined to one another in a relatively tight edge-to-edge and co-planar relationship. The combination of one bracket shoulder 54 of another plate 20 bearing on the bracket shoulder 54 of another plate 20 and the wedge 70 in the receiver yoke 68 prevents the plates from any substantial pivoting relative to one another. The result is a plate assembly that can be handled in much the same way as a single plate, which simplifies handling and installation. This relationship can be established with the embedment plates 20 in a position to be installed into a moldable material, such as concrete or asphalt or prior to installation. Once cured, the concrete or asphalt anchors the embedment plate 20 assembly.

Figure 3A:
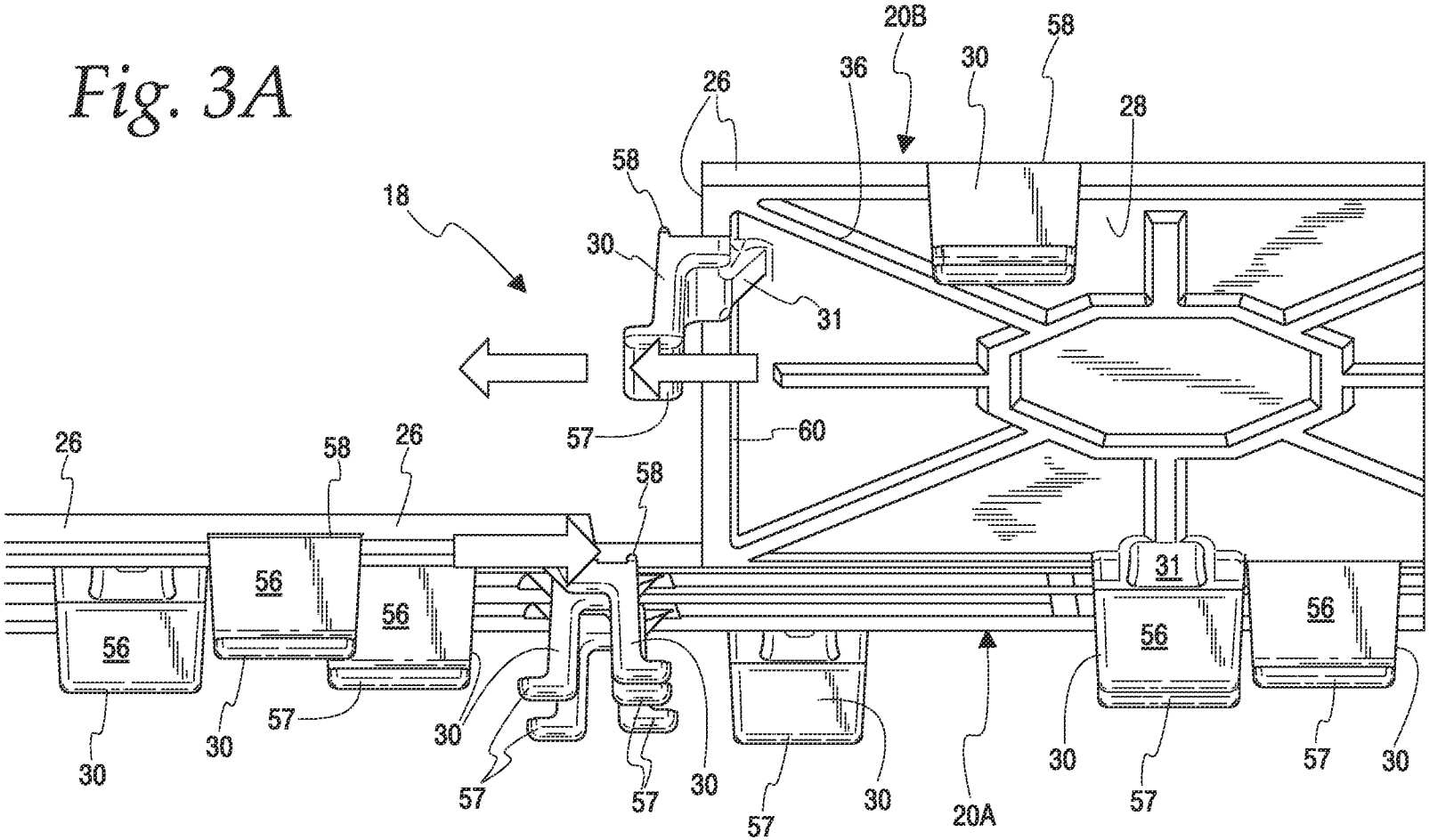
FIG. 3A is a partial side perspective view of a tactile embedment plate assembly being assembled in accordance with the present invention.
Figure 3B:
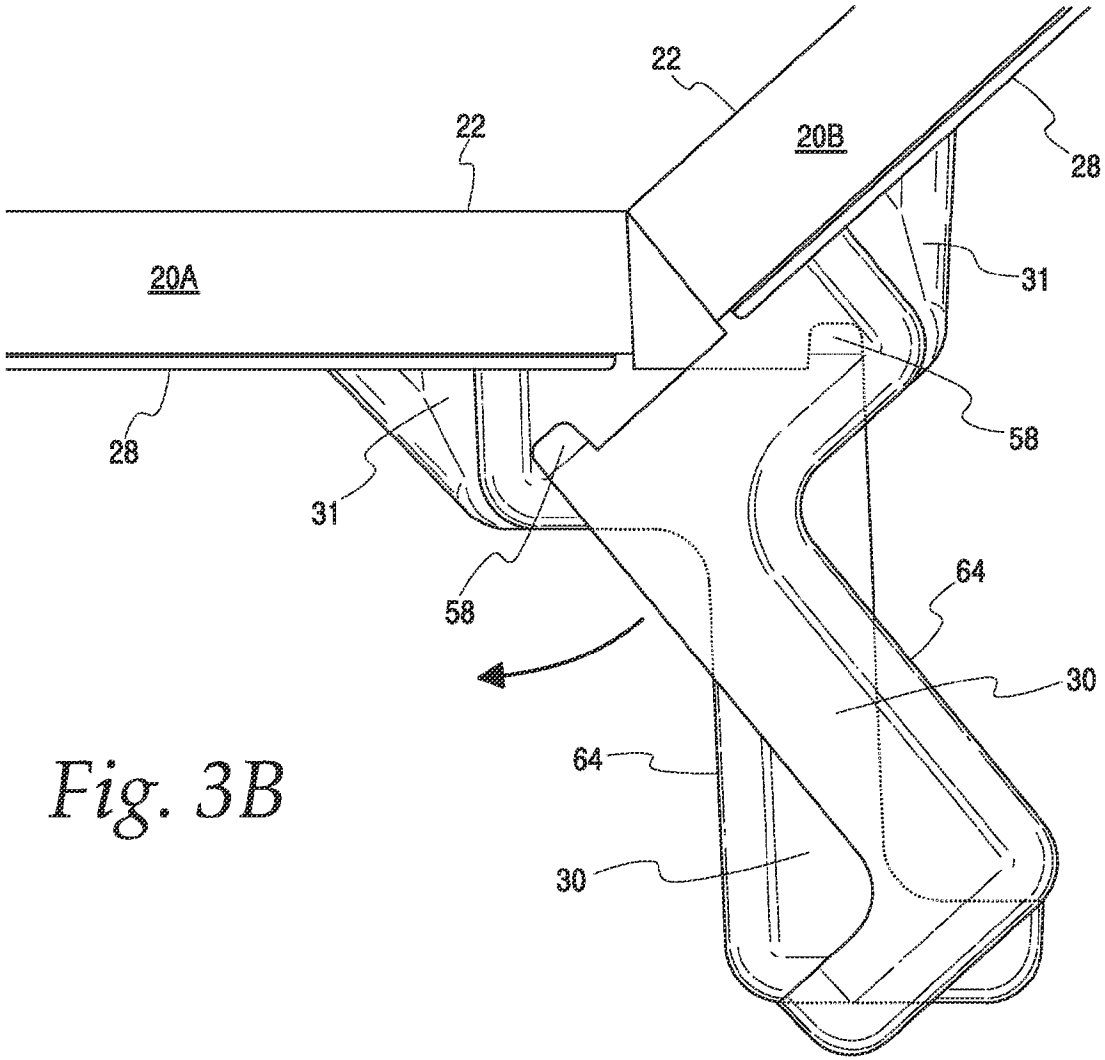
FIG. 3B is a partial side view of two embedment plates being assembled in accordance with the present invention.

As best depicted in FIGS. 3A and 3B, the present invention is also directed to a method for installing plate assemblies for being cast in concrete or asphalt pavement. The method can be performed at the site where the plates are to be installed or off site. The method preferably includes the steps of: setting a first plate in a desired position for a detectable warning surface; bringing a second plate substantially edge-to-edge and in a non-coplanar relationship with the first plate; and pivoting the second plate toward a co-planar position with the first plate to insert a bracket extending from the second plate under the first plate and into a co-planar position with the first plate to bring the bracket into bearing support of the first plate. The step of pivoting the second plate toward a co-planar position with the first plate preferably includes the step of: engaging a lip on the bracket of the second plate with a notch on the first plate to releasably join the second plate and the first plate in an edge-to-edge relationship. (See FIGS. 2, 3A, 5A and 5B.)

This method for installing tactile embedment plate assemblies can also include the step of sliding the second plate edge 26 along the first plate edge 26 before or after the lip 58 is engaged with the notch 60. This simplifies assembly because the plate edges 26 can be brought together first and then the second plate 20B can slide in either direction for better alignment with the first plate 20A and/or to adjust a spacing between the brackets 30 on the plates 20.

The step of pivoting the second plate toward a co-planar position with the first plate preferably includes the step of: aligning the bracket on the second plate with a bracket on the first plate to define a receiving yoke to arrive at the releasably joined plate assembly described above. This step is preferably followed by the step of: inserting a wedge into the receiving yoke. As seen in the figures, the step of pivoting the second plate toward a co-planar relationship with the first plate in the illustrated embodiment also brings a bracket on the first plate into bearing support of the second plate.

The plate assembly can be positioned in a desired location and then a moldable material can be placed around and under the plate assembly to form pavement having a detectable warning surface. Alternately, or in addition, the first plate and the second plate can be preassembled and placed as an assembly into uncured moldable material or assembled as described above in the uncured moldable material.

Placing the plates together as described results in a lip on the bracket engaging with a notch in the first plate to assemble the plate assembly. Even without a wedge, such an embodiment of the plate assembly can be lifted and installed into a pavement location to at least partially define a detectable warning surface. The pavement location can have the moldable pavement material already in place or it can be added after the plate assembly is installed into the pavement location.

Figures 7A, 7B, 7C, 7D:
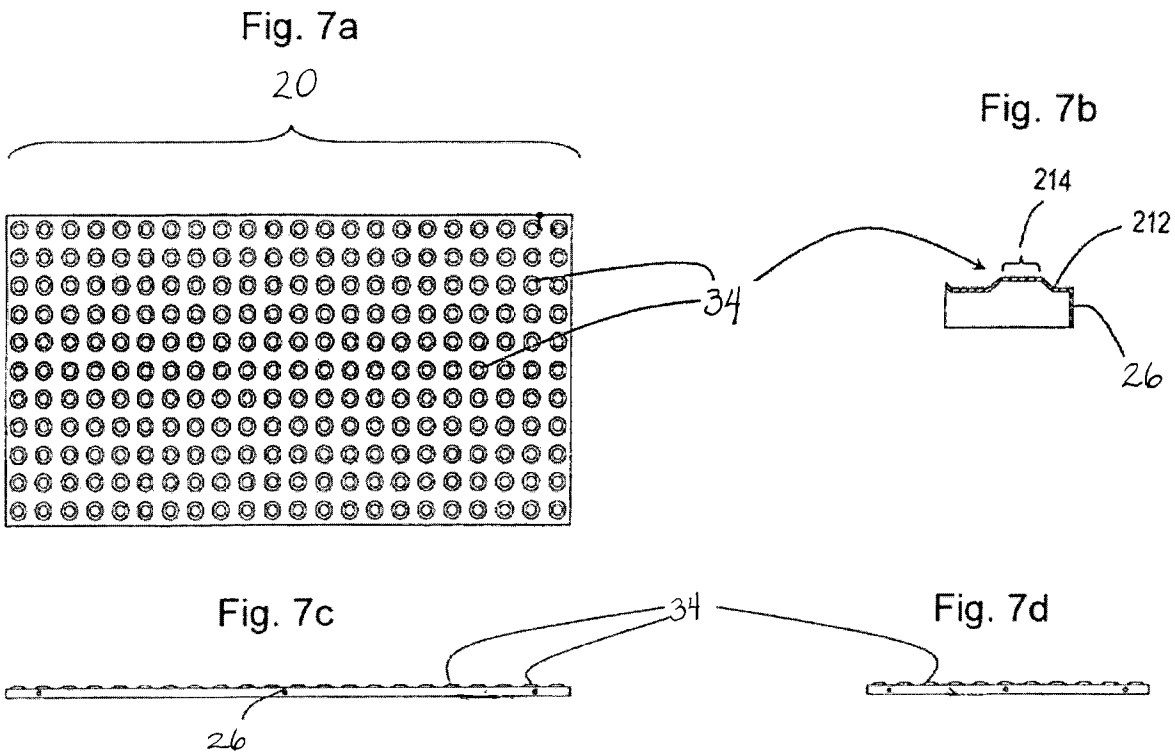
FIG. 7*a*, shows a top view detail of the embedment plate 20 depicted in the embedment tile of FIG. 1*a;*
FIG. 7*b*, shows the cross section indicated in FIG. 7*a* (i.e. B-B), detailing a projection 34 and an edge 26 of the embedment plate 20.
FIG. 7*c*, shows a side view (both sides being alike) of the embedment plate 20 depicted in FIG. 7*a;*
FIG. 7*d*, shows an end view (both ends being alike) of the embedment plate 20 depicted in FIG. 7*a;*

The shape and configuration of the projections 34 is preferably designed to with stand abuse from snow plows and other heavy equipment. Each tactile projection 34 of an embedment plate 20 generally includes a surface rising from a perimeter 212 to a central top portion 214 (FIG. 7*a*). As shown in the figures, the projections 34 are shaped like truncated domes where the projection's surface rises from a circular perimeter 212 to a flattened central top portion 214 (i.e., forming the truncated dome). Also as depicted, these projections 34 are distributed in a tactilely detectable warning pattern, i.e., the tactile projections 34 are distributed in a matrix of rows and columns in conformance with the ADAAG. As the ADA guidelines evolve over time or as users require conformance with other guidelines, the projections 34 may be altered in form, size, distribution pattern and spacing to meet those new requirements. For example, users may require the projections 34 to form a way-finder pattern, decorative design or some other pattern. U.S. patent application Ser. Nos. 12/077,739 and 13/370,753.

The projections 34 may further comprise several reinforcement ridges 216 (see FIG. 8*a*-8*c*). Reinforced ridges 216 function to strengthen projections 34 so that they are better able to endure impacts from other objects, to better protect the plate's surface coatings from wear, and to enhance the slip-resistance of the projections 34 themselves.

FIG. 8*c* shows one projection 34 with ridges 216 (on left) and one projection 34 without ridges 216 (on right) to illustrate the difference. In FIG. 3*b*, a top view is given to show that, in this particular version, 8 reinforcement ridges 216 are distributed evenly along the sides of the projection 34, extending from the perimeter 212 of each dome toward the central top portion 214, in this case extending slightly above the edge of the truncated top surface of the projection 34. In this way, an object impacting the projection 34 from any side, such as the blade of a snow plow when directed over a plate 20, would first hit one or more of the reinforcement ridges 216 on several of the projections 34. The ridge(s) 216 which would in turn lesson and/or divert impact of the object up and over the tops of the projections 34, thereby protect the domes. Likewise, the surface coating of the domes, including coatings on the top surface of the domes, would also be protected. In this way the reinforcement ridges 216 function to protect not only the underlying domes themselves but also the coatings on the surfaces of the domes. This results in higher durability of both the domes and the coatings, reducing the frequency with which either needs to be replaced.

The number, distribution pattern and sizing of the ridges 216 may vary according to the particular application and the particular type and sizing of upwardly extending projections 34 (e.g., according to whether the projections 34 are formed as truncated domes, diamonds or otherwise). The sizes depicted in FIGS. 8*a*-8*c* (inches [cm]), are given by way of example only.

The reinforcement ridges 216 may be formed by various methods. In versions of embedment plates 20 made from sheets of stainless steel or other metals, the projections 34 complete with reinforcement ridges 216 may be formed using a press. Other alternatives to forming the upwardly extending projections complete with ridges 216 may be employed, including forming them by molding or otherwise depending on the materials used (e.g., plastics, etc.).

Referring to FIGS. 7*a* to 7*d*, detailed views of the version of the embedment plate 20 depicted in FIG. 1*a* are provided. A top view is provided in FIG. 7*a*, side view in FIG. 7*c* and an end view in FIG. 7*d*. FIG. 7*b* shows a cross-sectional view through one of the projections 34 and one edge of the embedment plate 20 (defined as section B-B in FIG. 7*a*).

As mentioned above, the size of the embedment plate 20 as well as its shape and number of sides may vary depending on a user's needs. By way of example, in one version as depicted in FIGS. 7*a*-7*d*, the embedment plate 20 is about 24.0 inches (61 cm) wide by 48.0 inches (122 cm) long. Many other shapes and sizes are possible, including 2 foot square versions (24.0×24.0 inches; 61×61 cm), radial, wedge triangle and the like.

The upper surface of the embedment plate 20 may further be conditioned or surfaced so as to provide skid-resistance. For example, if the embedment plate 20 is made of a metal material, such as stainless steel, the upper surface might be etched or otherwise surfaced to provide skid-resistance. In addition or alternatively, the upper surface may be coated with a material to improve or provide its skid-resistant quality. Color for improved visual contrast of the embedment plate 20 may further be provided by treatment of the embedment plate 20 material itself, and/or by coating it with a colorant. A variety of techniques may be used to impart the embedment plate 20 with long-lasting color contrasting and skid resistance.

The foregoing detailed description is for clearness of understanding only, and no unnecessary limitations therefrom should be read into the following claims.

The invention claimed is:

1. A tactile embedment plate assembly comprising:
- a first plate;
- a first bracket joined to the first plate;
- a second plate arranged co-planar and adjacent to the first plate;
- a second bracket joined to the second plate and aligned with the first bracket to define a receiver yoke there between; and
- a wedge member disposed in the receiver yoke.

2. The tactile embedment plate assembly of claim 1, wherein:
- the first bracket includes a first wedge surface spaced apart from the first plate; and
- the second bracket includes a second wedge surface spaced apart from the second plate and the first wedge surface to define the receiver yoke.

3. The tactile embedment plate assembly of claim 1, wherein the receiver yoke is defined by:
- a first wedge surface on the first bracket, the first wedge surface is spaced apart from the first plate; and
- a second wedge surface on the second bracket, and the second wedge surface is spaced apart from the second plate and the first wedge surface.

4. The plate assembly of claim 1, wherein the first bracket is disposed adjacent to the second bracket.

5. The tactile embedment plate assembly of claim 1, and further comprising:
- a second pair of connecting brackets comprising:
  - a first bracket joined to the first plate; and
  - a second bracket joined to the second plate to define a receiver yoke therebetween.

6. The tactile embedment plate assembly of claim 1, wherein:
- the first bracket includes a first foot; and
- the second bracket includes a second foot.

7. The tactile embedment plate assembly of claim 1, wherein the wedge is a rod.

8. The tactile embedment plate assembly of claim 1, wherein the wedge is a rod with a substantially round cross-sectional shape.

9. A tactile embedment plate assembly comprising:
- a first plate;
- a first bracket joined to the first plate and the first bracket includes a shoulder;
- a second plate adjacent to and co-planar with the first plate and bearing at least partially on the first bracket shoulder;
- a second bracket joined to the second plate, and the second bracket includes a shoulder and the first plate bears at least partially on the second bracket shoulder; wherein
  - a receiver yoke is defined by the first bracket and the second bracket; and
- a wedge disposed in the receiver yoke.

10. The tactile embedment plate assembly of claim 9, wherein the receiver yoke is elongated and arranged substantially parallel to an edge of the second plate.

11. The tactile embedment plate assembly of claim 9, wherein the receiver yoke is wedge-shaped.

12. The tactile embedment plate assembly of claim 9, wherein:
- the receiver yoke is defined by a first wedge surface on the first bracket, and the first surface is spaced apart from the first plate, and
- a second surface on the second bracket, and the second surface is spaced apart from the second plate; and
- a wedge is wedged between the first surface and the second surface.

13. The tactile embedment plate assembly of claim 12, wherein the first surface and the second surface define the receiver yoke that is wedge-shaped.

14. The tactile embedment plate assembly of claim 12, wherein:
- the wedge is a rod.

15. The tactile embedment plate assembly of claim 9, wherein the wedge is a rod with a substantially round cross-sectional shape.

16. The tactile embedment plate assembly of claim 9, wherein:
- the first bracket shoulder includes a lip for engaging a notch in a lower surface second plate.

17. The tactile embedment plate assembly of claim 13, and further comprising:
- a lip on the second bracket for engaging a notch on the first embedment plate.

18. An alignment bracket for aligning a first tactile embedment plate to a second tactile embedment plate in a substantially co-planar relationship, the alignment connector comprising:
- a first bracket joined to the first tactile embedment plate;
- a second bracket joined to the second tactile embedment plate and aligned with the first bracket to define a receiver yoke; and
- a wedge releasably disposed in the receiver yoke.

19. The alignment bracket of claim 18, wherein the first bracket comprises:
- a shoulder on which the second tactile embedment plate bears.

20. The alignment bracket of claim 18, wherein the first bracket comprises:
- a shoulder on which the second tactile embedment plate bears; and a foot extending from the first bracket, substantially parallel to the first tactile embedment plate.

21. The alignment bracket of claim 18, wherein the first bracket comprises:

a shoulder on which the second tactile embedment plate bears; and a wedge surface that at least partially defines the receiver yoke.

22. The alignment bracket of claim 18, wherein:

the first bracket comprises:

a shoulder on which the second tactile embedment plate bears, and a wedge surface that at least partially defines the receiver yoke; and the second bracket comprises:

a shoulder on which the first tactile embedment plate bears and a wedge surface that at least partially defines the receiver yoke; and a wedge surface that at least partially defines the receiver yoke.

23. A method of installing plate assemblies for being cast in concrete or asphalt pavement which includes the steps of:

setting a first plate in a desired position;

bringing a second plate substantially edge-to-edge with the first plate;

pivoting the second plate toward a co-planar position with the first plate to insert a bracket extending from the second plate under the first plate and into a co-planar position with the first plate to bring the bracket into bearing support of the first plate by aligning the bracket on the second plate with a bracket on the first plate to define a receiving yoke; and inserting a wedge into the receiving yoke.

24. The method of claim 23, wherein the step of pivoting the second plate toward a co-planar position with the first plate comprises the step of:

engaging a lip on the bracket of the second plate with a notch on the first plate to releasably join the second plate and the first plate.

25. The method of claim 23, wherein the step of pivoting the second plate toward a co-planar relationship with the first plate comprises the step of:

bringing a bracket on the first plate into bearing support of the second plate.

26. The method of claim 23, and further including the step of:

placing a moldable material around and under the first plate and the second plate to form pavement having a detectable warning surface.

27. The method of claim 23, and further comprising the steps of:

engaging a lip on the bracket of the second plate with a notch in the first plate to create a plate assembly of the second plate and the first plate; and installing the plate assembly into a pavement location to at least partially define a detectable warning surface.

28. The method of claim 23, and further comprising the step of:

sliding an edge of the second plate along an edge of the first plate to adjust a spacing between the bracket on the first plate and a bracket on the second plate.

* * * * *